US009494892B2

(12) United States Patent
Akedo

(10) Patent No.: US 9,494,892 B2
(45) Date of Patent: Nov. 15, 2016

(54) TRANSPORTING APPARATUS, DEVELOPING APPARATUS AND IMAGE FORMING APPARATUS

(71) Applicant: Sharp Kabushiki Kaisha, Osaka-shi, Osaka (JP)

(72) Inventor: Shuichi Akedo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/690,602

(22) Filed: Apr. 20, 2015

(65) Prior Publication Data

US 2015/0331360 A1 Nov. 19, 2015

(30) Foreign Application Priority Data

May 13, 2014 (JP) ..... 2014-099219

(51) Int. Cl.
*G03G 15/08* (2006.01)

(52) U.S. Cl.
CPC ..... *G03G 15/0893* (2013.01); *G03G 15/0887* (2013.01); *G03G 15/0879* (2013.01); *G03G 2215/0132* (2013.01)

(58) Field of Classification Search
CPC ..... G03G 15/0844; G03G 14/0893; G03G 15/0887; G03G 15/0879; G03G 2215/0132
See application file for complete search history.

(56) References Cited

U.S. PATENT DOCUMENTS 5,436,703 A * 7/1995 DeYoung ..... G03G 15/0844 399/256
2005/0175376 A1* 8/2005 Sekiguchi ..... G03G 15/0886 399/258
2006/0165440 A1* 7/2006 Adachi ..... G03G 15/0844 399/254
2006/0239720 A1* 10/2006 Hirota ..... G03G 15/0877 399/258
2007/0098448 A1* 5/2007 Hart ..... G03G 15/09 399/254
2007/0183813 A1* 8/2007 Iwata ..... G03G 15/0877 399/227
2007/0269235 A1* 11/2007 Hirose ..... G03G 15/0893 399/254
2008/0170885 A1* 7/2008 Hatakeyama ..... G03G 15/0877 399/254
2008/0187332 A1* 8/2008 Tsuda ..... G03G 15/0898 399/27
2009/0103952 A1* 4/2009 Sakamoto ..... G03G 15/0877 399/258
2009/0214232 A1* 8/2009 Murauchi ..... G03G 15/0849 399/30
2009/0214233 A1* 8/2009 Murauchi ..... G03G 15/0877 399/30
2009/0214266 A1* 8/2009 Kato ..... G03G 15/0877 399/254
2009/0245879 A1* 10/2009 Minami ..... G03G 15/0822 399/255
2009/0290886 A1* 11/2009 Murauchi ..... G03G 15/0844 399/27

(Continued)

FOREIGN PATENT DOCUMENTS

JP 2001265098 A * 9/2001
JP 2005091914 A * 4/2005

(Continued)

*Primary Examiner* — David Bolduc
(74) *Attorney, Agent, or Firm* — Keating & Bennett, LLP

(57) ABSTRACT

A developing apparatus includes a developer vessel that is provided with a first transporting path, a second transporting path and a third transporting path. The first transporting path and the second transporting path are communicated with each other, and a developer is circulated in the first transporting path and the second transporting path. The third transporting path has a developer discharge port and is provided in an upstream side in a transporting direction of the developer in the second transporting path. Furthermore, an annular plate-like first regulation portion is arranged in an end portion of the second transporting path in a third transporting path side and an annular plate-like second regulation portion opposite to the first regulation portion with a predetermined interval is arranged in an end portion of the third transporting path in a second transporting path side.

7 Claims, 12 Drawing Sheets

(56) References Cited

U.S. PATENT DOCUMENTS

2009/0290887 A1* 11/2009 Murauchi ..... G03G 15/0844 399/27
2009/0310984 A1* 12/2009 Sakatani ..... G03G 15/0856 399/30
2009/0310985 A1* 12/2009 Hirata ..... G03G 15/0853 399/30
2009/0317141 A1* 12/2009 Okazaki ..... G03G 15/0877 399/254
2010/0215406 A1* 8/2010 Ozawa ..... G03G 15/0808 399/257
2010/0303507 A1* 12/2010 Isono ..... G03G 15/0893 399/254
2010/0322671 A1* 12/2010 Tsutsui ..... G03G 15/0887 399/254
2010/0322672 A1* 12/2010 Murauchi ..... G03G 15/0887 399/254
2010/0322673 A1* 12/2010 Murauchi ..... G03G 15/0822 399/254
2010/0322674 A1 12/2010 Saito et al.
2010/0322675 A1* 12/2010 Tsutsui ..... G03G 15/0822 399/254
2011/0013944 A1* 1/2011 Kawaguchi ..... G03G 15/0877 399/257
2011/0150533 A1* 6/2011 Saito ..... G03G 15/0893 399/234
2011/0150535 A1* 6/2011 Murauchi ..... G03G 15/10 399/254
2011/0150537 A1* 6/2011 Watanabe ..... G03G 15/0839 399/256
2011/0170888 A1* 7/2011 Suzaki ..... G03G 15/0822 399/53
2011/0229209 A1* 9/2011 Takaya ..... G03G 15/0844 399/257
2011/0236074 A1* 9/2011 Maeda ..... G03G 15/0893 399/254
2011/0311279 A1* 12/2011 Okazaki ..... G03G 15/0887 399/254
2012/0002983 A1* 1/2012 Kataoka ..... G03G 15/0863 399/12
2012/0070194 A1* 3/2012 Okuno ..... G03G 15/0893 399/254
2012/0121279 A1* 5/2012 Kitagawa ..... G03G 15/0831 399/35
2012/0189349 A1* 7/2012 Okuno ..... G03G 15/0189 399/254
2013/0223873 A1* 8/2013 Manabe ..... G03G 15/0844 399/102
2013/0343784 A1* 12/2013 Fujimura ..... G03G 15/0893 399/255
2014/0205311 A1* 7/2014 Kashimoto ..... G03G 15/0889 399/98
2014/0369718 A1* 12/2014 Furuta ..... G03G 15/0849 399/259
2015/0003876 A1* 1/2015 Iida ..... G03G 15/0891 399/254
2015/0139696 A1* 5/2015 Ishida ..... G03G 15/0893 399/254
2015/0139697 A1* 5/2015 Tsukijima ..... G03G 15/0893 399/254
2015/0168871 A1* 6/2015 Sakamaki ..... G03G 15/0893 399/254

FOREIGN PATENT DOCUMENTS

JP 2005092059 A * 4/2005
JP 2010237329 A * 10/2010
JP 2010256701 A * 11/2010
JP 2011-002767 A 1/2011
JP 2012155144 A * 8/2012
JP 2013025123 A * 2/2013

* cited by examiner

TRANSPORTING APPARATUS, DEVELOPING APPARATUS AND IMAGE FORMING APPARATUS

CROSS REFERENCE OF RELATED APPLICATION

The disclosure of Japanese patent application No. 2014-099219 filed on May 13, 2014 is incorporated by reference.

BACKGROUND OF THE INVENTION

Field of the Invention

The present invention relates to a transporting apparatus, a developing apparatus and an image forming apparatus, and more specifically, a transporting apparatus that transports a developer within a developer vessel, and a developing apparatus and an image forming apparatus.

Description of the Related Art

An example of a conventional developing apparatus is disclosed in Japanese patent application laying-open No. 2011-2767 [G03G 15/08] (Patent Literature 1) laid-open on Jan. 6, 2011. The developing apparatus of the patent literature 1 is a developing apparatus that adopts a trickle development system among electrophotography system using a developer that consists of two components, a toner and a carrier. Briefly describing, the trickle development system means a technology that a new carrier is mixed to a toner in a toner cartridge with a predetermined ratio, and the new carrier is supplied to a developing apparatus with supply of the toner, and a carrier that deteriorated is sequentially replaced with the new carrier by discharging the surplus developer from the developing apparatus.

In the technology of the patent literature 1, a developer supplying/collecting portion and a developer churning portion are provided adjacent to each other and form a circulation path of the developer within the developer vessel. The developer supplying/collecting portion is provided with a transporting member (screw) that supplies a toner to a developer bearing member and transports a developer in a longitudinal direction to send the developer to the developer churning portion. Furthermore, the developer churning portion is provided with two churning members (screws) adjacent to each other, which transport the developer in a direction reverse to a transporting direction by the transporting member while churning to send to the developer supplying/collecting portion. Then, there is provided with, in a downstream side of a developer transporting direction of a first churning member, a braking portion that suppresses discharge of the developer, and a developer discharge portion that comprises a developer discharge port is provided in a downstream side than the braking portion. The braking portion is provided with a disk that faces a direction orthogonally intersecting the developer transporting direction and a reverse winding portion in an upstream side of the developer transporting direction than the disk.

In the technology of the patent literature 1, an amount of the developer that is discharged from a discharge portion (developer discharge port) is suppressed by providing the braking portion in the downstream side of the developer transporting direction of the first churning member. However, since the braking portion is provided on a line that is extended coaxially with the first churning member, the developer transported by the first churning member flows into the discharge portion more than required by an impetus thereof. Furthermore, there is an occasion that the developer flows into the discharge portion more than required due to splash raising of the developer by rotation of the churning member (screw), an internal pressure difference that occurs by rotation of a developing roller (magnet roller) between the developer supplying/collecting portion and the developer churning portion and the discharge portion, etc. That is, with the technology of the patent literature 1, it is impossible to say that discharge control of the developer is enough, and therefore, there is a possibility that a developer may be discharged excessively.

SUMMARY OF THE INVENTION

Therefore, it is a primary object of the present invention to provide a transporting apparatus, developing apparatus and image forming apparatus, capable of adequately preventing a developer from being discharged excessively.

The present invention adopts the following structure in order to solve the above-described problem.

A transporting apparatus according to a first invention comprises a first transporting path, a second transporting path and a third transporting path that are provided in a developer vessel. The first transporting path and the second transporting path are arranged in parallel with each other, and communicate with each other via communicating paths that are formed in both end portions in a longitudinal direction of a boundary wall between the first transporting path and the second transporting path. The first transporting path is provided with a first transporting member that transports a developer while churning. The second transporting path is provided with a second transporting member that transports a developer while churning in a reverse direction to the first transporting member and supplies the developer to a developer bearing member. The third transporting path is connected to the second transporting path in an upstream side of a transporting direction of the developer by the second transporting member. The third transporting path is provided with a third transporting member. The third transporting member transports a developer that overflows from the second transporting path to a developer discharge port that is formed in the third transporting path. An annular plate-like first regulation portion that is projected from an outer peripheral surface of an axis of the second transporting member and extended in a circumferential direction is provided in an end portion of the second transporting path in a third transporting path side and an annular plate-like second regulation portion that is opposite to the first regulation portion with a predetermined interval is arranged in an end portion of the third transporting path in a second transporting path side.

In such a transporting apparatus, by discharging the developer that overflows to the third transporting path in an upstream side of the transporting direction of the developer in the second transporting path, the developer becomes to adequately overflow to the third transporting path without just receiving an influence by an impetus of the developer transported in the first transporting path and the second transporting path. In addition, since the first regulation portion is provided in the end portion of the second transporting path in the third transporting path side, even if fluidity of the developer changes due to environmental change or change of toner concentration, for example, it is possible to suppress that the developer flows to the third transporting path from the second transporting path more than required. Furthermore, by providing the second regulation portion in the end portion of the third transporting path in the second transporting path side, it is possible not only to suppress that the developer flows to the third transporting path from the second transporting path more than required but to suppress that the developer enters to the third transporting path more than required due to splash raising of the developer by rotation of agitating vanes of the second transporting member and an internal pressure difference that occurs by rotation of a developing roller between the second transporting path and the third transporting path.

According to the first invention, since the developer that overflows to the third transporting path from the second transporting path is discharged, the developer can be discharged without largely receiving the influence of the impetus of the developer transported in the first transporting path and the second transporting path. Furthermore, by providing the first regulation portion and the second regulation portion, it is possible not only to suppress that the developer flows to the third transporting path from the second transporting path more than required even if fluidity of the developer changes but to suppress that the developer enters to the third transporting path more than required due to the splash raising of the developer and the internal pressure difference between the second transporting path and the third transporting path. Therefore, excessive discharge of the developer is adequately prevented.

In the transporting apparatus according to a second invention, the second regulation portion is formed in a shape of an annular plate that is projected from an outer peripheral surface of an axis of the third transporting member and extended in a circumferential direction.

According to the second invention, like the first invention, excessive discharge of the developer is adequately prevented.

In the transporting apparatus according to a third invention, the second regulation portion is formed in a shape of an annular plate that is projected from an inner circumferential surface of the third transporting path and extended in a circumferential direction.

According to the third invention, like the first invention, excessive discharge of the developer is adequately prevented.

In the transporting apparatus according to a fourth invention, the third transporting path is formed coaxially with the second transporting path, and an inner diameter of the third transporting path is formed smaller than an inner diameter of the second transporting path.

According to the fourth invention, since a stepwise difference is formed in a connecting portion of the second transporting path and the third transporting path, even if a transporting apparatus inclines, a large amount of developer does not overflow toward the third transporting path from the second transporting path. That is, the developer is not discharged more than required.

In the transporting apparatus according to a fifth invention, the second transporting path has an expanded portion that is formed to be projected to a third transporting path side in comparison to the communicating path that is arranged in the third transporting path side.

According to the fifth invention, since the distance from communicating path to the third transporting path becomes long, it is possible to more surely suppress that the developer transported in the first transporting path flows to the third transporting path with an impetus as it is.

The transporting apparatus according to a sixth invention further comprises an annular plate-like third regulation portion that is arranged in an end portion of the third transporting path in a second transporting path side to be opposed to the second regulation portion with a predetermined interval. Like the second regulation portion, the third regulation portion suppresses that the developer flows to the third transporting path from the second transporting path more than required and that the developer enters to the third transporting path more than required due to splash raising of the developer by rotation of the second transporting member and an internal pressure difference that occurs by rotation of a developing roller between the second transporting path and the third transporting path.

According to the sixth invention, since the third regulation portion is comprised in addition to the first regulation portion and the second regulation portion, excessive discharge of the developer can be prevented more surely.

A seventh invention is a developing apparatus comprising the transporting apparatus according to the first invention and a developer bearing member.

Also in the seventh invention, like the first invention, excessive discharge of the developer is adequately prevented.

An eighth invention is an image forming apparatus comprising the developing apparatus according to the seventh invention.

Also in the eighth invention, like the seventh invention, excessive discharge of the developer is adequately prevented.

The above mentioned objects and other objects, features, aspects and advantages of the present invention will become more apparent from the following detailed description of the present invention when taken in conjunction with the accompanying drawings.

DETAILED DESCRIPTION OF NON-LIMITING EXAMPLE EMBODIMENTS

First Embodiment

Figure 1:
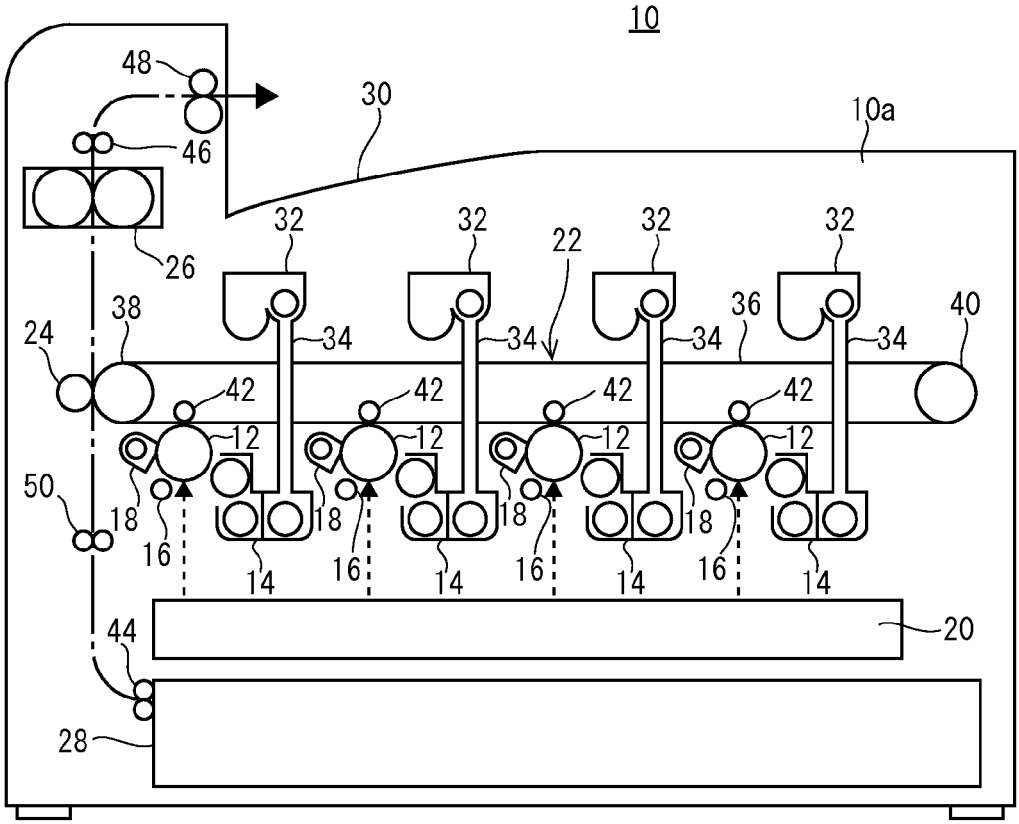
FIG. 1 is a schematic view showing an example of an outline of entire structure of an image forming apparatus of a first embodiment.

FIG. 1 is a schematic structural view viewing from the front a whole of an image forming apparatus 10 that is an embodiment according to the present invention.

With reference to FIG. 1, the image forming apparatus 10 of the first embodiment is a full color printer, and forms a multicolor or monochromatic image on a paper (recording medium) according to an electrophotography system. However, the image forming apparatus 10 may be a monochromatic printer. Furthermore, the image forming apparatus 10 need not to be limited to a printer, and may be a copying apparatus, a facsimile or a multifunction apparatus possessed with these functions.

At first, basic structure of the image forming apparatus 10 will be schematically described. As shown in FIG. 1, the image forming apparatus 10 comprises components such as a photoreceptor drum 12, a developing apparatus 14, a charger 16, a cleaning unit 18, an exposure device 20, an intermediate transfer belt unit 22, a secondary transfer roller 24, a fixing unit 26, etc. and an image is formed on a paper that is fed from a paper feeding tray 28, and a paper having been formed with the image is discharged to a discharge tray 30. As image data for forming an image on a paper, image data that is input from an external computer is utilized. However, when the image forming apparatus 10 comprises a scanner function, it is possible to use not only the image data that is input from an outside but also image data that is read from an original by a scanner.

Respective above-described components are accommodated in a housing 10*a* of the image forming apparatus 10. Furthermore, in the housing 10*a* of the image forming apparatus 10, a control portion comprising a CPU, a memory, etc. not shown is provided. The control portion transmits control signals to respective parts of the image forming apparatus 10, and makes the image forming apparatus 10 perform various kinds of operations or actions.

Here, image data treated in the image forming apparatus 10 is image data according to a color image of four (4) colors of black (BK), magenta (M), cyan (C) and yellow (Y). Therefore, the photoreceptor drum 12, the developing apparatus 14, the charger 16 and the cleaning unit 18 are respectively provided by four (4) such that four kinds of latent images corresponding to the respective colors can be formed, and four image stations are constituted by these components. The four image stations are arranged in a line along a travelling direction (circumferential moving direction) of a surface of the intermediate transfer belt 36, and the image stations for black, magenta, cyan and yellow are arranged in this order from a downstream side in the travelling direction of the surface of the intermediate transfer belt 36, that is, from a side close to the secondary transfer roller 24. However, an arrangement order of respective colors is changeable suitably.

At each image station, the charger 16, the developing apparatus 14 and the cleaning unit 18 are arranged around the photoreceptor drum 12 in this order in a rotation direction thereof (counterclockwise in FIG. 1). The developing apparatus 14 is arranged such that a rotation axis of a developing roller 156 (see FIG. 2) becomes in parallel with a rotation axis of the photoreceptor drum 12. Furthermore, the charger 16 is arranged such that own rotation axis becomes in parallel with the rotation axis of the photoreceptor drum 12. Furthermore, the cleaning unit 18 is arranged such that a longitudinal direction of a cleaning blade (not shown) corresponds to an axial direction of the rotation axis of the photoreceptor drum 12. It should be noted that an axial direction of the rotation axis of the photoreceptor drum 12 is a depth direction (front and rear direction) when viewing the image forming apparatus 10 from the front.

The photoreceptor drum 12 is supported to be rotated around the axis by a driving portion not shown, and is an image carrying member that a photosensitive layer (photoconductive layer) is formed on a surface of a substrate having conductivity. The substrate can take various kinds of forms or shapes such as a hollow cylindrical shape, a solid cylindrical shape, a shape of a thin film sheet, etc. The photosensitive layer is formed of a material that shows conductivity when irradiated with a light. As the photoreceptor drum 12 of the first embodiment, a thing that includes the cylindrical substrate formed of aluminum and the photosensitive layer that is formed on an outer peripheral surface of the substrate and is formed of amorphous silicon (a-Si), selenium (Se) or an organic photo-semiconductor (OPC) can be used.

The developing apparatus 14 visualizes (forms a toner image) with a toner an electrostatic latent image formed on the surface of the photoreceptor drum 12. A toner cartridge 32 is connected to the developing apparatus 14 by a toner supply pipe 34. The toner cartridge 32 is a container that stores an unused toner and an unused carrier and is arranged above the developing apparatus 14 to supply (resupply) a toner and a carrier to the developing apparatus 14. The toner supply pipe 34 couples (connects) the toner cartridge 32 and a toner resupply port 144*a* (see FIG. 2) that is formed in the developing apparatus 14 to each other. Details of the developing apparatus 14 will be described later.

The charger 16 is a device that charges the surface of the photoreceptor drum 12 in a predetermined polarity and electrical potential. As the charger 16, a brush type charger, a roller type charger, a corona charger, an ion generator, etc. can be used.

The cleaning unit 18 removes and collects the toner that remains on the surface of the photoreceptor drum 12 after the toner image is transferred from the photoreceptor drum 12 to the intermediate transfer belt 36 to clean the surface of the photoreceptor drum 12. Therefore, the cleaning unit 18 comprises a cleaning blade for removing the toner and a recovery container for recovering the toner removed, for example.

The exposure device 20 is provided below the developing apparatus 14. The exposure device 20 is constructed as a laser scanning unit (LSU) that comprises a laser irradiating portion and reflecting mirrors, and by exposing the surface of the photoreceptor drum 12 that is charged, forms an electrostatic latent image according to image data on the surface of the photoreceptor drum 12.

The intermediate transfer belt unit 22 comprises an intermediate transfer belt 36, a driving roller 38, a driven roller 40, four (4) intermediates transfer rollers (primary transfer rollers) 42, etc., and is arranged above the photoreceptor drum 12.

The intermediate transfer belt 36 is an endless belt having flexibility, and formed of a synthetic resin, rubber, or the like that a conductive material such as a carbon black, etc. is combined therewith. The intermediate transfer belt 36 is stretched over a plurality of rollers such as a driving roller 38, a driven roller 40, etc., and arranged such that a surface (outer peripheral surface) is brought into contact with the surface of the photoreceptor drum 12. Then, the intermediate transfer belt 36 is rotated (circularly moved) in a predetermined direction (clockwise in FIG. 1) accompanying with rotation drive of the driving roller 38.

The driving roller 38 is provided so as to be rotated around an axial line thereof by a driving portion not shown. The driven roller 40 is rotated following circular movement of the intermediate transfer belt 36, and applies a constant tension to the intermediate transfer belt 36 to prevent slack of the intermediate transfer belt 36.

Each of the intermediate transfer rollers 42 is arranged in a position opposite to corresponding one of the photoreceptor drums 12 via the intermediate transfer belt 36, and is brought into pressure-contact to an inner circumferential surface of the intermediate transfer belt 36 to be rotated with the circular movement of the intermediate transfer belt 36. Although not shown, a transfer power supply that applies a transfer bias is connected to the intermediate transfer rollers 42. When forming an image, a voltage having a polarity reverse to a charged polarity of a toner that forms the toner image on the surface of the photoreceptor drum 12 is applied to the intermediate transfer rollers 42. Accordingly, a transfer electric field is formed between the photoreceptor drum 12 and the intermediate transfer belt 36, and by an action of this transfer electric field, the toner image that is formed on the photoreceptor drum 12 is transferred onto the outer peripheral surface of the intermediate transfer belt 36. When forming a color image, for example, the toner image of each color formed in each photoreceptor drum 12 is transferred (primary transfer) one by one on the intermediate transfer belt 36 to be overlapped, whereby a multicolor toner image can be formed on the outer peripheral surface of the intermediate transfer belt 36.

Furthermore, the secondary transfer roller 24 is arranged in a position opposite to the driving roller 38 via the intermediate transfer belt 36. A transfer power supply not shown is connected to the secondary transfer roller 24, and a voltage (secondary transfer voltage) is applied to the secondary transfer roller 24 by this transfer power supply when forming an image. Then, by an action of a transfer electric field formed by the secondary transfer roller 24 that the voltage is applied, the toner image formed on the outer peripheral surface of the intermediate transfer belt 36 is transferred (secondary transfer voltage) to a paper during the paper passes through a transfer nip region between the intermediate transfer belt 36 and the secondary transfer roller 24. Then, the toner that remains on the surface of the intermediate transfer belt 36 is removed and collected by a transfer belt cleaning unit not shown.

The fixing unit 26 comprises a hot roller, a pressure roller etc., and is arranged above the secondary transfer roller 24. The hot roller is controlled to be rendered at a predetermined fixing temperature, and when a paper passes a fixing nip region between the hot roller and the pressure roller, the toner image that is transferred to the paper is melted, mixed and pressured, whereby the toner image can be heat-fixed on the paper.

Furthermore, in the housing 10*a* of the image forming apparatus 10, there is formed with a paper feeding path for feeding the paper put on the paper feeding tray 28 to the paper discharge tray 30 via the secondary transfer roller 24 and the fixing unit 26. A paper feeding portion such as feeding rollers 44, 46, 48 and a resist roller 50 and so on is adequately arranged in this paper path.

When forming an image, a paper put on the paper feeding tray 28 is fed to the paper feeding path one by one by a pickup roller not shown and fed to the resist roller 50. Then, the paper is fed at a timing that a tip end of the paper and a tip end of the toner image on the intermediate transfer belt 36 are consistent with each other by the resist roller 50, whereby the toner image can be transferred on the paper. Then, an unfixed toner on a paper is melted and fixed when the paper passes through the fixing unit 26, and the paper is discharged on the paper discharge tray 30 through the transporting rollers 46 and 48.

In such an image forming apparatus 10, as described later, the developer (two-component developer) that includes a toner of black, cyan, magenta or yellow and a carrier is stored in the developer vessel 140 that is provided in the developing apparatus 14. In addition, the carrier is a magnetic material such as an iron powder or ferrite. The same applies hereinafter.

The developing apparatus 14 is a developing apparatus of a trickle development system, for example. Briefly describing, the trickle development system means a technology that a new carrier is mixed to a toner in the toner cartridge 32 with a predetermined ratio, and a carrier that deteriorated is sequentially replaced with a new carrier by supplying (resupplying) a new carrier to the developing apparatus 14 when supplying (resupplying) a toner and by discharging the developer that becomes excessive from the developing apparatus 14.

In this specification, although it says "The developer is discharged", etc., this means that the carrier that deteriorated or the developer that the carrier that deteriorated and the toner are mixed is discharged. Although the carrier that deteriorated is not necessarily replaced with an unused carrier, the developing apparatus 14 is basically constituted such that the carrier that deteriorated is replaced with an unused carrier.

In the developing apparatus 14, if a toner is consumed by forming an image on a paper, the toner corresponding to a consumption amount is resupplied. To this end, a toner concentration detection sensor (not shown) is provided on the bottom of the developer vessel 140, for example, and toner concentration (T/D: T is a toner and D is a developer) in the developer vessel 140 is detected based on a detection result of this toner concentration detection sensor. Then, resupply of a toner is controlled according to the toner concentration detected.

As the toner concentration detection sensor, in general, a transmission-type optical sensor, a reflection-type optical sensor or a permeability sensor is used. It is preferable to use the permeability sensor among them. The permeability is changed by a rate of the magnetic material in a developer. That is, if a mixture ratio of a magnetic material and a nonmagnetic material in the developer changes, that is, if relative concentration of a magnetic material changes, an output of the permeability sensor changes. Therefore, the concentration of the carrier that is a magnetic material in the developer can be measured by detecting the permeability of the developer. Alternatively, the concentration of the toner that is the nonmagnetic material in the developer can be measured.

In such a developing apparatus 14, in order to uniformly and fully charge the toner in the developer vessel 140 while using for a long period of time as much as possible, when resupplying an unused toner from the toner cartridge 30, an unused career is also resupplied as described above. Furthermore, a part of the developer that is stored in the developer vessel 140 is discharged. Therefore, the carrier that deteriorated is replaced with an unused carrier.

Therefore, it is important not only to control the amounts of the toner and the carrier that are resupplied but to suitably set discharge amounts of the carrier and the developer. For this reason, in the developing apparatus 14 of the first embodiment, following structure is adopted. In the following, the structure of the developing apparatus 14 will be specifically described.

Figure 2:
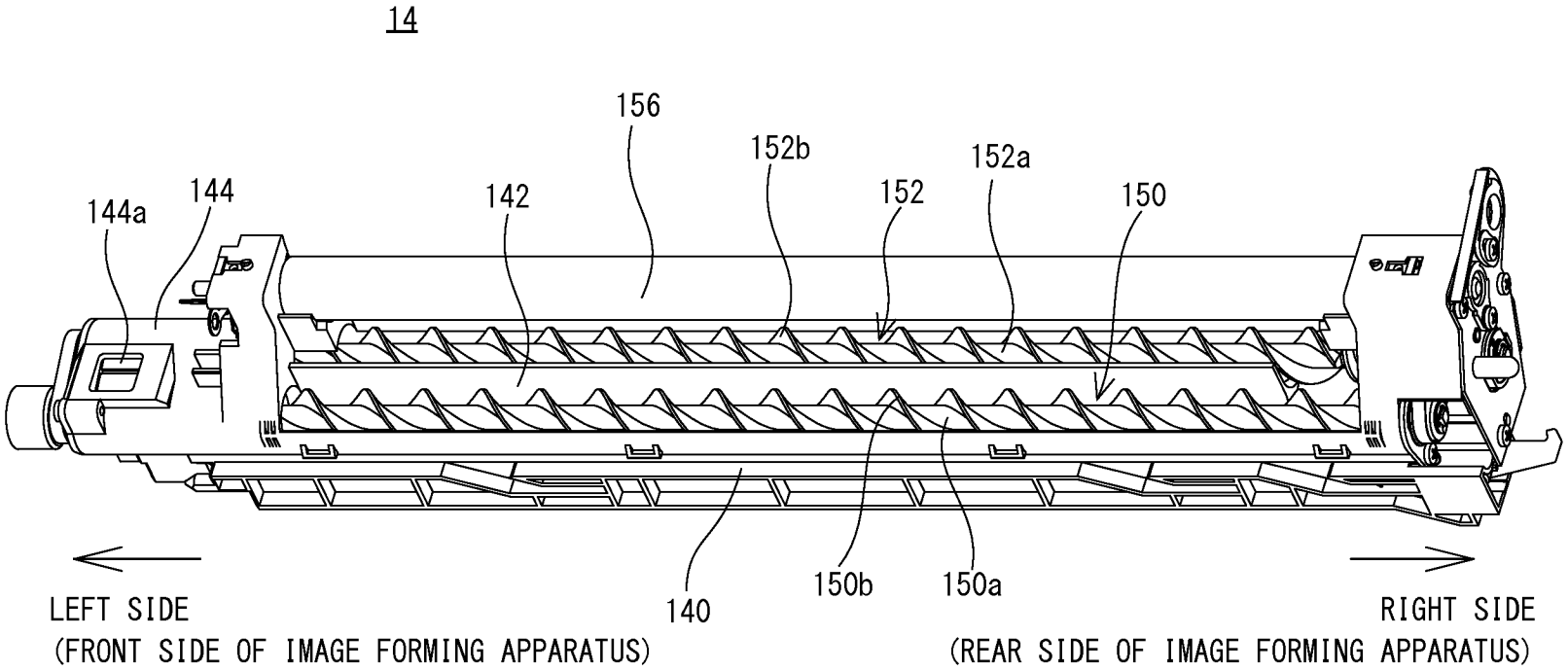
FIG. 2 is a perspective view diagonally viewing down specific appearance constitution of a developing apparatus shown in FIG. 1.
Figure 3:
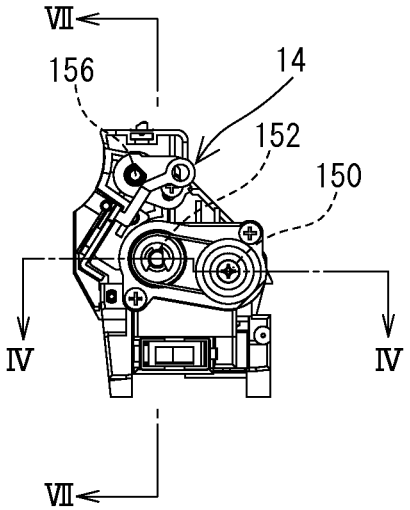
FIG. 3 is a schematic view viewing the developing apparatus shown in FIG. 2 from a left side surface.
Figure 4:
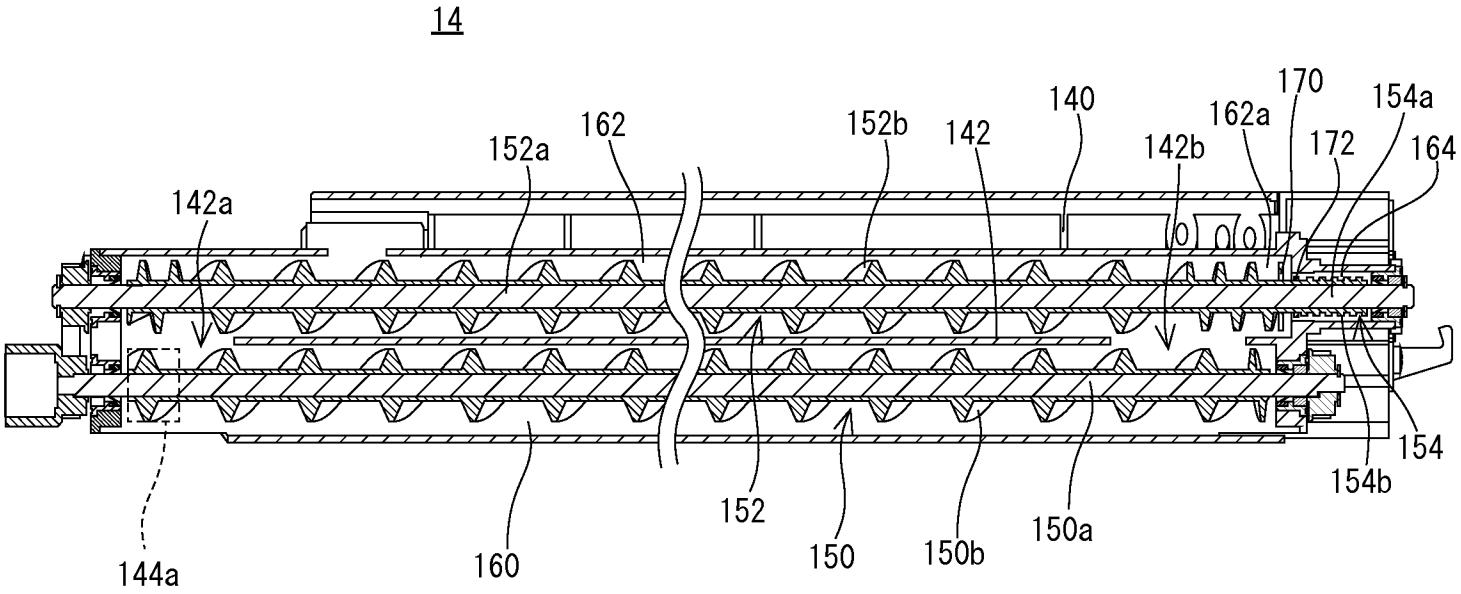
FIG. 4 is a sectional view at a line IV-IV in FIG. 3.

FIG. 2 is a perspective view obliquely viewing down specific appearance structure of the developing apparatus 14. Furthermore, FIG. 3 is a side view viewing the developing apparatus 14 from a left side. Furthermore, FIG. 4 is a IV-IV sectional view of FIG. 3. It should be noted that a left side of the developing apparatus 14 shown in FIG. 2 is arranged in the front side of the image forming apparatus 10 shown in FIG. 1, and a right side of the developing apparatus 14 shown in FIG. 2 is arranged in the rear side of the image forming apparatus 10 shown in FIG. 1.

As shown in FIG. 2 to FIG. 4, the developing apparatus 14 includes the developer vessel 140, a boundary wall 142, a vessel cover 144, a first transporting member 150, a second transporting member 152, a third transporting member 154, a developing roller (magnet roller) 156, etc.

The vessel cover 144 is a member that is attached to an upper opening of the developer vessel 140 to cover above the first transporting member 150, the second transporting member 152, the developing roller 156, etc. However, a part of the vessel cover 144 is omitted in FIG. 2. Furthermore, although a doctor blade and the toner concentration detection sensor described above are also included in the developing apparatus 14, the doctor blade and the toner concentration detection sensor are omitted in FIG. 2 as well as a part of the vessel cover 144.

The developer vessel 140 stores the developer (two-component developer) that the carrier and the toner are mixed, as described above. In addition, the first transporting member 150, the second transporting member 152, the third transporting member 154 and the developing roller 156 described above are provided inside the developer vessel 140.

However, the toner, the carrier and the developer that these are mixed are not shown.

Furthermore, a thing excluding the developing roller 156 and the doctor blade from the developing apparatus 14 may be called a transporting apparatus that transports the developer.

Within the developer vessel 140, the first transporting member 150 and the second transporting member 152 are rotatably arranged such that the respective rotation axes are in parallel with each other. The third transporting member 154 is formed coaxially and integrally with the second transporting member 152.

Furthermore, within the developer vessel 140, there is provided with the boundary wall 142 that extends in a direction of the rotation axes of the first transporting member 150 and the second transporting member 152 between the first transporting member 150 and the second transporting member 152 so as to divide an inside of the developer vessel 140. Therefore, in the developer vessel 140, a first transporting path 160 that the developer is transported by the first transporting member 150 is formed and a second transporting path 162 that the developer is transported by the second transporting member 152 is formed. Furthermore, in the developer vessel 140, the third transporting path 164 that the developer is transported by the third transporting member 154 is formed. This third transporting path 164 is connected (coupled) to the second transporting path 162 in an upstream side of the transporting direction of the developer by the second transporting member 152. In this third transporting path 164, a developer discharge port 146 (see FIG. 7) for discharging the developer that becomes excessive to an outside is formed at the bottom in a downstream side in the transporting direction of the developer by the third transporting member 154.

Furthermore, slits 142*a* and 142*b* are formed in both end portions on a longitudinal direction of the boundary wall 142. The slit 142*a* and the slit 142*b* function as the communicating paths that make the first transporting path 160 and the second transporting path 162 communicate with each other.

Furthermore, the second transporting path 162 has an expanded portion 162*a* that is formed to be projected to a third transporting path 164 side in comparison to the slit (communicating path) 142*b* that is arranged in the third transporting path 164 side. Since the second transporting path 162 has the expanded portion 162*a*, a distance from the slit 142*b* to the third transporting path 164 becomes long, and therefore, it is possible to suppress that the developer transported in the first transporting path 160 overflows (enters) to the third transporting path 164 with an impetus as it is. Furthermore, by adjusting a length (axial direction length) in an axial direction of the rotation axis of the second transporting member 152 of this expanded portion 162*a*, it is possible to adjust fluidity of the developer, that is, it is possible to adjust an amount of the developer that flows to the third transporting path 164 from an end portion of the second transporting path 162 in a third transporting path 164 side. In addition, if lengthening the length in the axial direction of the expanded portion 162*a* too much, the developer that should be discharged becomes not to overflow to the third transporting path 164, it is necessary to set the axial direction length of the expanded portion 162*a* to such an extent that such inconvenience does not occur.

Each of the second transporting path 162 and the third transporting path 164 is formed in a cylindrical shape or approximately cylindrical shape (the first transporting path 160 is also the same). The third transporting path 164 is coaxial with the second transporting path 162, and an inner diameter of the third transporting path 164 is formed smaller than an inner diameter of the second transporting path 162. Therefore, a stepwise difference having a vertical surface 166 is formed in a connecting portion (boundary portion) of the second transporting path 162 and the third transporting path 164 (see FIG. 6 and FIG. 7). By thus forming the second transporting path 162 and the third transporting path 164, even if the developing apparatus 14 inclines, for example, it is possible to prevent that a large amount of developer overflowing to the third transporting path 164 from the second transporting path 162. Therefore, it is possible to suppress that the developer is discharged from the third transporting path 164 more than required.

Furthermore, in the developer vessel 140, the developing roller 156 is arranged above the second transporting member 152. The developing roller 156 functions as a developer bearing member, and is arranged in a position opposite to the photoreceptor drum 12 (see FIG. 1). The developing roller 156 bears the developer in the developer vessel 140 on a surface thereof to supply the toner included in the developer that is borne to the surface of the photoreceptor drum 12. Accordingly, the electrostatic latent image that is formed on the surface of the photoreceptor drum 12 is developed (visualized).

In addition, although not shown, the doctor blade is fixed to the developer vessel 140 with a predetermined gap to the surface of the developing roller 156. The doctor blade is a tabular member extending in a direction of the axis of the developing roller 156. By this doctor blade, an amount of the developer that is borne on the developing roller 156 is regulated to a predetermined amount.

Furthermore, as well seen in FIG. 2, the developing apparatus 14 is formed with a toner resupply port 144*a* above the first transporting member 150 in an upstream end portion of the vessel cover 144 in the transporting direction that the developer is transported by the first transporting member 150. The toner supply pipe 34 extended from the toner cartridge 32 is coupled to the toner resupply port 144*a*, and a toner and a carrier are resupplied in the developer vessel 140 from this toner resupply port 144*a*.

As shown in FIG. 2 and FIG. 4, the first transporting member 150 is an auger screw that agitating vanes 150*b* for transporting the developer while churning is formed on the screw axis (rotation axis) 150*a*. In this first transporting member 150, the agitating vanes 150*b* is reversely wound in a downstream end portion (right end portion in FIG. 2 and FIG. 4) of the transporting direction of the developer.

The second transporting member 152 is also an auger screw that agitating vanes 152*b* for transporting the developer while churning is formed on the screw axis 152*a*. In the second transporting member 152, a pitch of the agitating vanes 152*b* is shortened in an upstream end portion (right end portion in FIG. 2 and FIG. 4) of the transporting direction of the developer. Furthermore, in the second transporting member 152, the agitating vanes 152*b* is reversely wound and a pitch of the agitating vanes 152*b* is shortened in a downstream end portion (left end portion in FIG. 2 and FIG. 4) of the transporting direction of the developer.

Furthermore, in the second transporting member 152, a first annular plate 170 is provided in the expanded portion 162*a* of the end of the second transporting path 162 in a third transporting path 164 side. The first annular plate 170 is formed in a shape of an annular plate (flange shape) that is projected from an outer peripheral surface of the screw axis 152*a* and extended in a circumferential direction. An outer diameter of the first annular plate 170 is made approximately the same as an outer diameter of the agitating vanes 152*b*, and a gap or space between an outer peripheral end of the first annular plate 170 and an inner circumferential surface of the second transporting path 162 (expanded portion 162*a*) is made to be 1-2 mm, for example. Furthermore, a gap or space between the first annular plate 170 and the above-described vertical surface 166 (that is, a second annular plate 172 described later) is made to be 1.5-2.5 mm, for example. Such a first annular plate 170 functions as a first regulation portion that suppresses that the developer flows to the third transporting path 164 from the second transporting path 162 more than required (excessively) even when fluidity of the developer changes with environmental change or toner concentration change, for example.

Furthermore, the third transporting member 154 has the screw axis 154*a* that is coaxial with the screw axis 152*a* of the second transporting member 152, and the agitating vanes 154*b* that is reversely wound to the agitating vanes 152*b* of the second transporting member 152. An outer diameter of the agitating vanes 154*b* is made smaller than that of the agitating vanes 152*b*.

Furthermore, in an end portion of the third transporting path 164 in a second transporting path 162 side, there is provided with a second annular plate 172 that is arranged to be opposite to the first annular plate 170. The second annular plate 172 is formed in shape of an annular plate (flange shape) that is projected from an outer peripheral surface of the screw axis 154*a* and extended in a circumferential direction. An outer diameter of the second annular plate 172 is made approximately the same as an outer diameter of the agitating vanes 154*b*, and a gap or space between an outer peripheral end of the second annular plate 172 and an inner circumferential surface of the third transporting path 164 is made to be 0.6-1.0 mm, for example. Furthermore, the above-described vertical plane 166 and a side surface of the second annular plate 172 in a second transporting path 162 side are formed in the same plane. Such a second annular plate 172 functions as a second regulation portion that suppresses that the developer flows to the third transporting path 164 from the second transporting path 162 more than required and that the developer enters to the third transporting path 164 more than required due to splash raising of the developer by the rotation of the second transporting member 152 (agitating vanes 152*a*) and an internal pressure difference that occurs between the second transporting path 162 and the third transporting path 164 due to the rotation of the developing roller 156.

Figure 5:
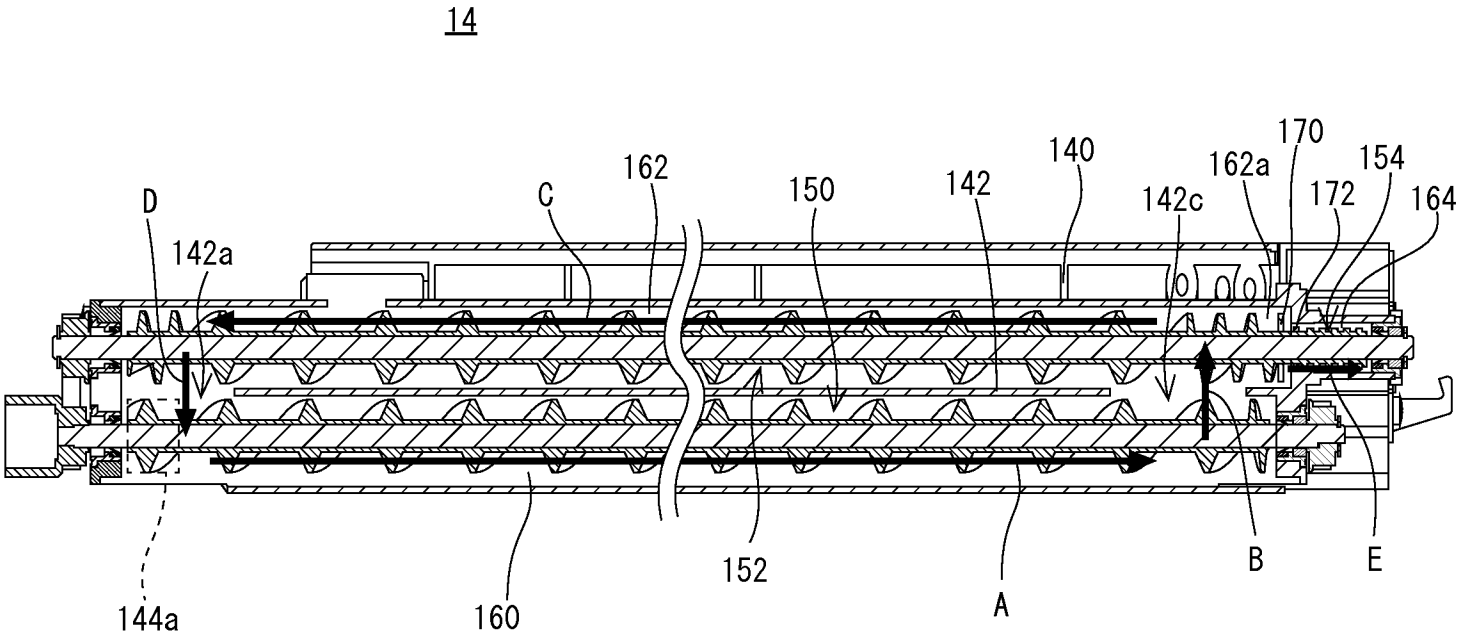
FIG. 5 is a schematic view showing the flow of a developer in the developing apparatus shown in FIG. 4.
Figure 6:
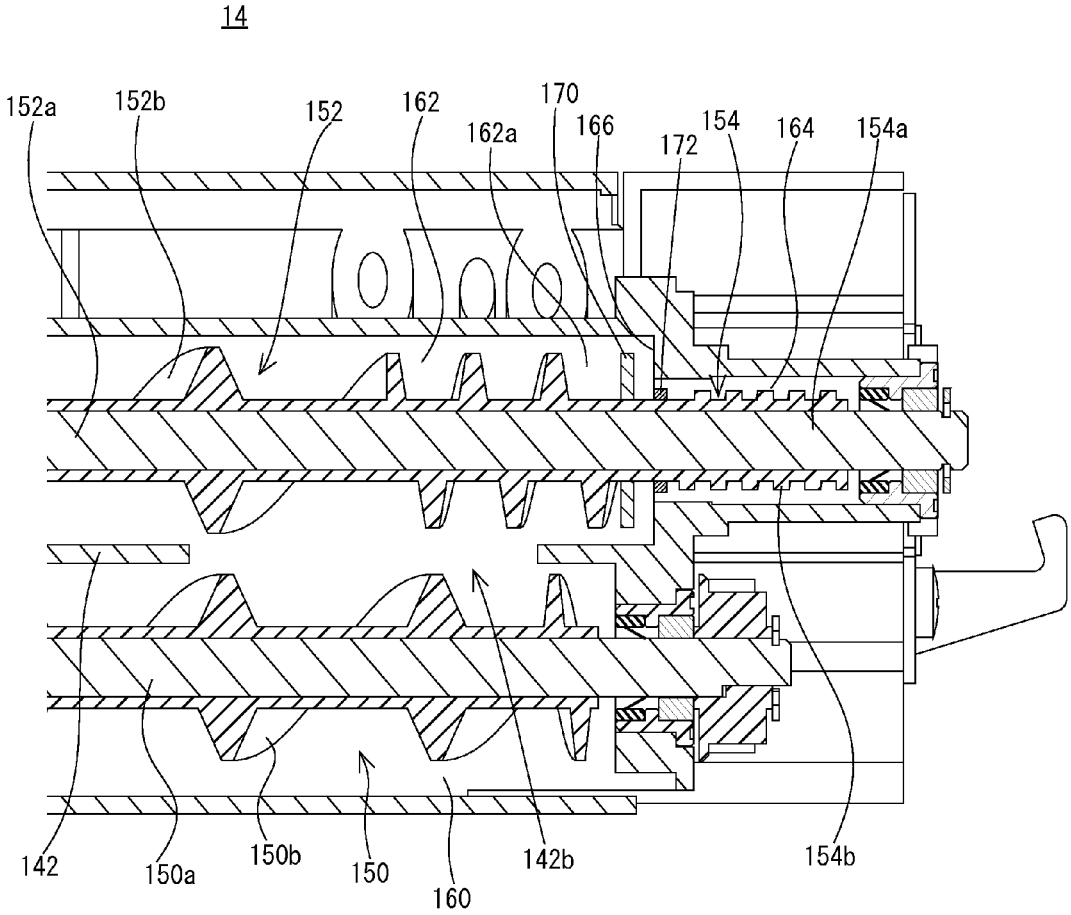
FIG. 6 is a schematic view enlarging a part of the sectional view shown in FIG. 4.
Figure 7:
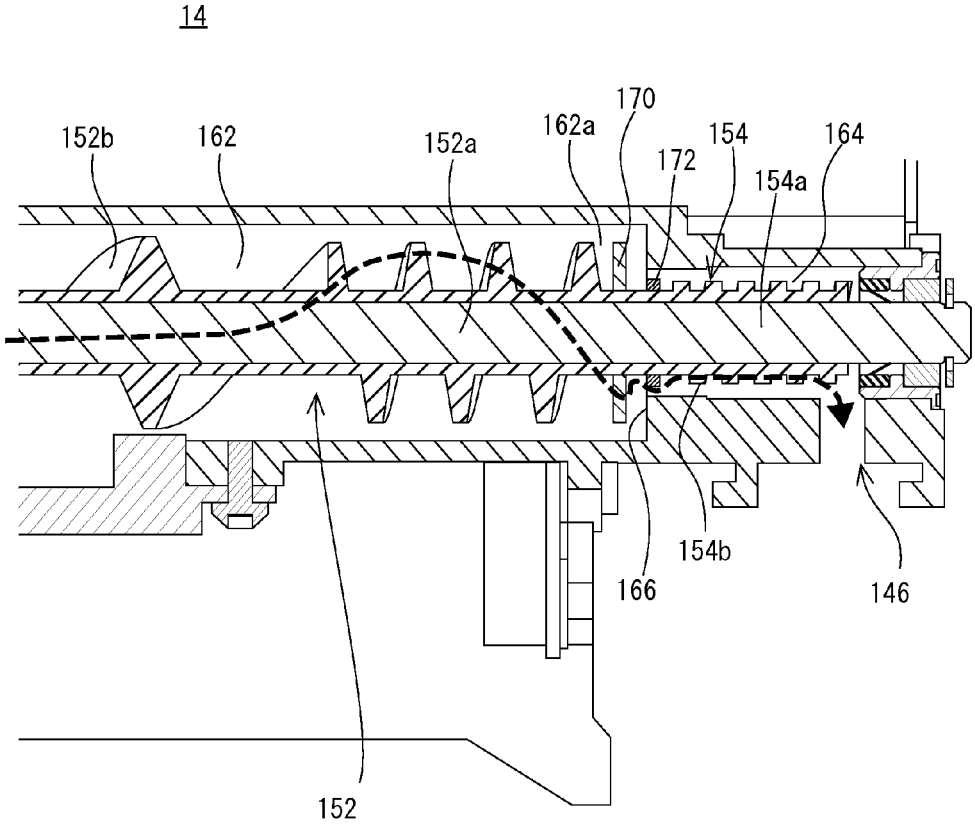
FIG. 7 is a schematic view showing a part of a sectional view at a line VII-VII in FIG. 3.

In the following, with reference to FIG. 5-FIG. 7, flow (action) of the developer that is transported inside the developer vessel 140 will be described. FIG. 5 is a schematic view indicating a transporting direction of the developer in the sectional view of FIG. 4. Furthermore, FIG. 6 is an enlarged view that the right end portion of FIG. 4 is enlarged, and FIG. 7 is a view showing a part of VII-VII sectional view of FIG. 3. In addition, in FIG. 7, a part of an upstream side in the transporting direction of the developer of the second transporting path 162 and the third transporting path 164 are shown while omitting the developing roller 156 and the doctor blade.

In this first embodiment, the screw axis 150*a* of the first transporting member 150 and the screw axis 152*a* of the second transporting member 152 (screw axis 154*a* of third transporting member 154) are rotated in a reverse direction to each other. Therefore, in the first embodiment, the developer is transported in the first transporting path 160 toward a side of the slit 142*b* from a side of the slit 142*a*, and the developer is transported in the second transporting path 162 toward the side of the slit 142*a* from the side of the slit 142*b*. That is, the transporting direction of the developer transported in the first transporting path 160 and the transporting direction of the developer transported in the second transporting path 162 are in reverse.

Furthermore, the developer transported in the first transporting path 160 is blocked by the wall (inner side wall) of the developer vessel 140 in a downstream end portion in the transporting direction of the first transporting path 160. Therefore, the developer stays in the downstream end portion of the transporting direction of the first transporting path 160, and is pushed out (moved) to the second transporting path 162 from the slit 142*b*.

On the other hand, the developer transported in the second transporting path 162 is blocked by the wall (inner side wall) of the developer vessel 140 in a downstream end portion in the transporting direction of the second transporting path 162. Therefore, the developer stays in the downstream end portion of the transporting direction of the second transporting path 162, and is pushed out (moved) to the first transporting path 160 from the slit 142*a*.

Since the first transporting path 160 and the second transporting path 162 are thus communicated with each other by the slit 142*a* and the slit 142*b* within the developer vessel 140, the developer in the developer vessel 140 is circulated by rotating the first transporting member 150 and the second transporting member 152. In FIG. 5, as shown by arrow marks A, B, C and D, the developer is circulated inside the developer vessel 140.

Here, as described above, the toner resupply port 144*a* is formed in the upstream side (left end portion in FIG. 5) of the transporting direction of the developer in the first transporting path 160. That is, an unused toner from the toner cartridge 30 is resupplied to the upstream side of the transporting direction of the developer in the first transporting path 160 together with an unused carrier.

Furthermore, the third transporting path 164 is connected to the second transporting path 162 in the upstream side of the transporting direction of the developer by the second transporting member 152, and the stepwise difference having the vertical plane 166 is formed in the connecting portion of the second transporting path 162 and the third transporting path 164.

Therefore, if the developer surmounts the stepwise difference having the vertical surface 166 in the upstream end portion of the transporting direction of the developer by the second transporting member 152 of the second transporting path 162 and overflows from the second transporting path 162 to the third transporting path 164, the developer that overflows is transported by the third transporting member 154 in a direction reverse to the transporting direction in the second transporting path 162. Then, the developer that is transported in the third transporting path 164 is discharged from the developer discharge port 146. As shown by a thick dotted line in FIG. 7, for example, if a surface of the developer surmounts the stepwise difference in the third transporting path 164, a part of the developer that surmounts is transported to the developer discharge port 146 in a direction shown by an arrow mark E of FIG. 5.

Thus, in the developing apparatus 14 of the first embodiment, it is constructed such that the developer that overflows to the third transporting path 164 in the upstream end portion of the transporting direction of the developer in the second transporting path 162 can be discharged.

In addition, it is supposed that the developing apparatus 14 (developer vessel 140) is provisionally constructed such that the developer is discharged in the downstream side of the transporting direction of the developer in the first transporting path 160. That is, it is assumed that the third transporting path 164 is provided in the downstream end side of the transporting direction of the developer in the first transporting path 160, and the third transporting member 154 is formed integrally and coaxially with the transporting member 150. Then, the developer transported in the first transporting path 160 overflows to the third transporting path 164 with an impetus that is hardly reduced. In this, the developer is discharged excessively.

In addition, in a case where the developing apparatus 14 (developer vessel 140) is provisionally constructed such that the developer is discharged in the downstream side of the transporting direction of the developer in the second transporting path 162, as similar to the case where the developer is discharged in the downstream side of the transporting direction of the developer in the first transporting path 160, the developer is discharged excessively.

Furthermore, in a case where the developing apparatus 14 (developer vessel 140) is provisionally constructed such that the developer is discharged in the upstream side of the transporting direction of the developer in the first transporting path 160, it is impossible to exchange the carrier that deteriorated with an unused carrier because an unused toner and an unused carrier that are resupplied are discharged as they are.

Therefore, in the first embodiment, it is constructed such that the developer that overflows to the third transporting path 164 is discharged in the upstream side of the transporting direction of the developer in the second transporting path 162. Accordingly, the developer overflows appropriately to the third transporting path 164 without receiving the influence by the impetus of the developer transported in the first transporting path 160 and the second transporting path 162 as it is.

Moreover, in the developing apparatus 14 of the first embodiment, there is provided with the first annular plate (the first regulation portion) 170 that is projected from the outer peripheral surface of the screw axis 152*a* of the second transporting member 152 and extended in the circumferential direction in the end portion of the second transporting path 162 in the third transporting path 164 side. Accordingly, it is possible to suppress that the developer flows to the third transporting path 164 from the second transporting path 162 more than required even when fluidity of the developer changes with environmental change or toner concentration change, for example.

Furthermore, in the developing apparatus 14 of the first embodiment, there is provided with the second annular plate (the second regulation portion) 172 that is projected from the outer peripheral surface of the screw axis 154*a* of the third transporting member 154 and extended in the circumferential direction in the end portion of the third transporting path 164 in the second transporting path 162 side. Accordingly, it is possible to suppress that the developer flows to the third transporting path 164 from the second transporting path 162 more than required and that the developer enters to the third transporting path 164 more than required due to the splash raising of the developer by the rotation of the agitating vanes 152*b* of the second transporting member 152, etc. and the internal pressure difference that occurs between the second transporting path 162 and the third transporting path 164 due to the rotation of the developing roller 156.

As described above, according to this first embodiment, since the developer that overflows to the third transporting path 164 in the upstream side of the transporting direction of the developer in the second transporting path 162 is discharged, the influence of the impetus of the developer transported in the first transporting path 160 and the second transporting path 162 is not largely received, and therefore, it is possible to adequately prevent the developer from being discharged excessively.

Furthermore, according to the first embodiment, since the first annular plate (the first regulation portion) 170 is provided in the end portion of the second transporting path 162 in the third transporting path 164 side, even when the fluidity of the developer changes, it is suppressed that the developer flows to the third transporting path 164 from the second transporting path 162 more than required.

Furthermore, according to the first embodiment, since the second annular plate (the second regulation portion) 172 is provided in the end portion of the third transporting path 164 in the second transporting path 162 side, it is suppressed that the developer enters into the third transporting path 164 more than required due to the splash raising of the developer and the internal pressure difference between the second transporting path 162 and the third transporting path 164.

Moreover, according to the first embodiment, since the inner diameter of the third transporting path 164 is made smaller than the inner diameter of the second transporting path 162 such that the coupling portion of the second transporting path 162 and the third transporting path 164 is formed with the stepwise difference, even if the developing apparatus 14 inclines, only a few developer overflows to a third transporting path 164 side. That is, the developer can be prevented as possible from being discharged uselessly.

Furthermore, according to the first embodiment, since the second transporting path 162 has the expanded portion 162*a* that is formed to be projected to a side of third transporting path 164 in comparison to the slit (communicating path) 142*b* that is arranged in the third transporting path 164 side, a distance from the slit 142*b* to the third transporting path 164 becomes long. Therefore, it is possible to more surely suppress that the developer transported from the first transporting path 160 flows to the third transporting path 164 with the impetus as it is.

Second Embodiment

Figure 8:
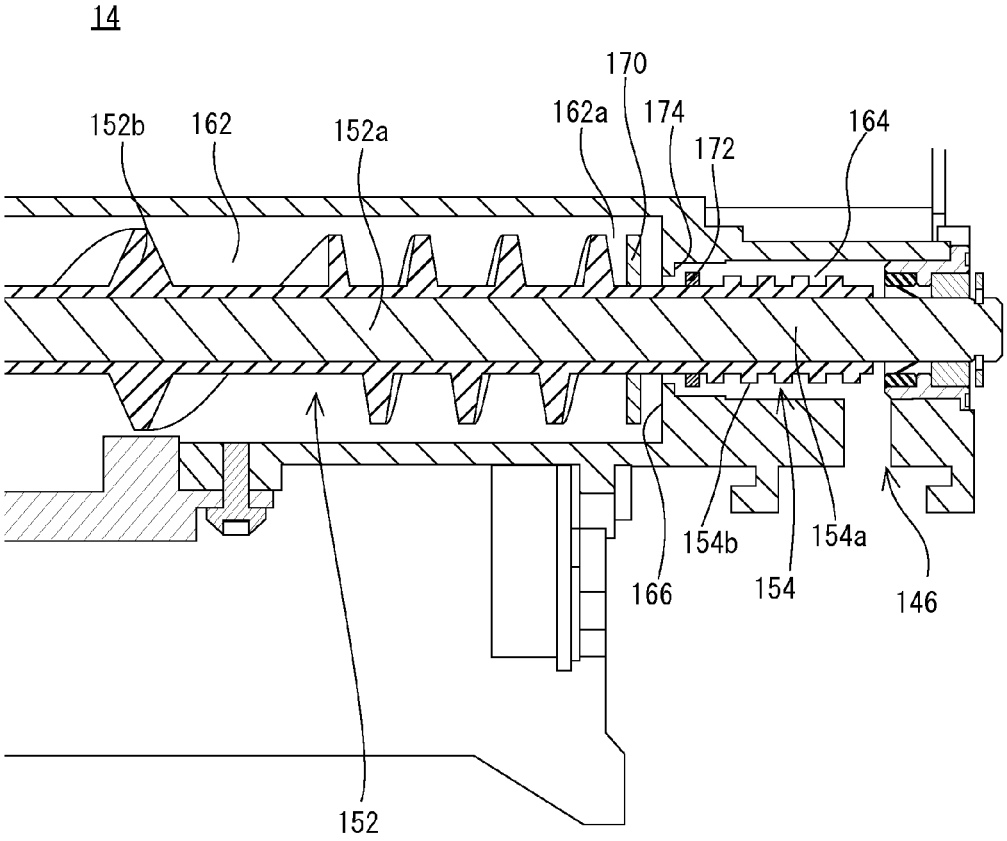
FIG. 8 is a schematic view enlarging a part of a sectional view of a developing apparatus of a second embodiment.

Next, an image forming apparatus 10 of the second embodiment according to the present invention will be described with reference to FIG. 8. Since the image forming apparatus 10 of the second embodiment is the same as the first embodiment except partly changing the structure of the developing apparatus 14, a duplicate description is omitted. FIG. 8 is a schematic view enlarging a part of a sectional view of the developing apparatus 14 of the second embodiment, corresponding to FIG. 7 in the first embodiment.

Briefly describing, the second embodiment further comprises, in addition to the first annular plate 170 provided in the end portion of the second transporting path 162 in the third transporting path 164 side and the second annular plate 172 provided in the end portion of the third transporting path 164 in the second transporting path 162 side, a third annular plate 174 that is provided in an end portion of the third transporting path 164 in the second transporting path 162 side.

The third annular plate 174 is arranged in the end portion of the third transporting path 164 in the second transporting path 162 side to be opposed to the second annular plate 172, and is formed in a shape of an annular plate that is projected from an inner circumference surface of the third transporting path 164 and extended in a circumferential direction. A gap or space between the inner circumferential end of the third annular plate 174 and the outer peripheral surface of the screw axis 154*a* of the third transporting member 154 is made to be 0.6-1.0 mm, for example. Furthermore, the above-described vertical surface 166 and a side surface of the third annular plate 174 in the second transporting path 162 side are formed on the same plane. In addition, since the third annular plate 174 is formed, the second annular plate 172 is arranged in a position slightly departed from the vertical surface 166 to the downstream side in the transporting direction of the developer by the third transporting member 154. An interval between the third annular plate 174 and the second annular plate 172 is made to be 0.6-1.0 mm, for example.

Such a third annular plate 174 suppresses that the developer flows into the third transporting path 164 from the second transporting path 162 more than required, and functions as a third regulation portion that the developer enters to the third transporting path 164 more than required due to the splash raising of the developer by the rotation of the second transporting member 152 (agitating vanes 152*a*), etc. and the internal pressure difference that occurs between the second transporting path 162 and the third transporting path 164 due to the rotation of the developing roller 156.

Therefore, according to the second embodiment, since the third annular plate (the third regulation portion) 174 is provided in addition to the first annular plate (the first regulation portion) 170 and the second annular plate (the second regulation portion) 172, the developer is more surely prevented from being discharged excessively.

It should be noted that the second regulation portion and the third regulation portion are names for expediently distinguishing the regulation portion provided in the third transporting path 164, and it is also possible to say that the third annular plate 174 functions as the second regulation portion and the second annular plate 172 functions as the third regulation portion.

Third Embodiment

Figure 9:
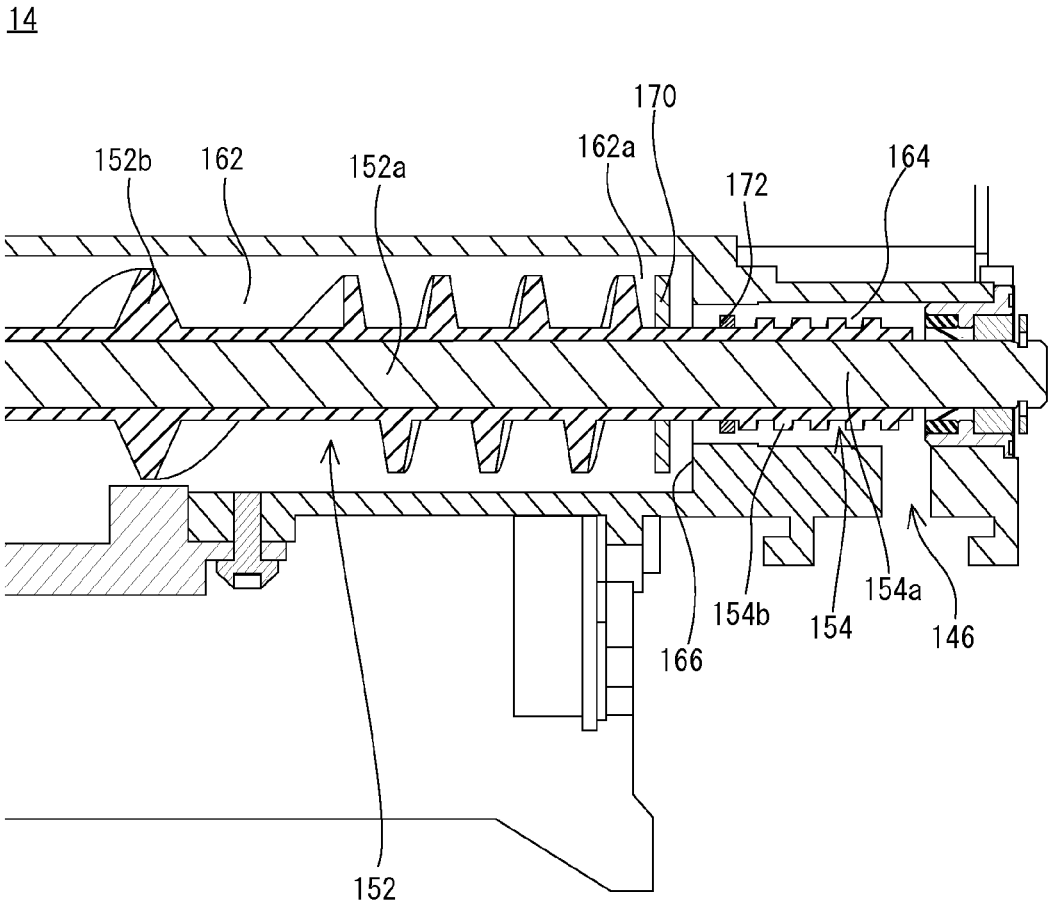
FIG. 9 is a schematic view enlarging a part of a sectional view of a developing apparatus of a third embodiment.

Subsequently, an image forming apparatus 10 that is the third embodiment according to the present invention will be described with reference to FIG. 9. Since the image forming apparatus 10 of the third embodiment is the same as the first embodiment except partly changing the structure of the developing apparatus 14, a duplicate description is omitted. FIG. 9 is a schematic view enlarging a part of a sectional view of the developing apparatus 14 of the third embodiment, corresponding to FIG. 7 in the first embodiment.

Briefly describing, in the third embodiment, the second annular plate (the second regulation portion) 172 is arranged in a position slightly departed from the vertical plane 166 to the downstream side in the transporting direction of the developer by the third transporting member 154. An interval between the vertical plane 166 and a side surface of the second annular plate 172 in a first annular plate 170 side is made to be 1.0-2.0 mm, for example.

By thus arranging the second annular plate 172, developer stagnation is formed near the side surface of the second annular plate 172 in a first annular plate 170 side on the bottom of the end portion of the third transporting path 164 in the second transporting path 162 side. Then, since this developer stagnation serves as a barrier, it is suppressed that the developer flows into the third transporting path 164 from the second transporting path 162 more than required.

In also the third embodiment, like the first embodiment, the developer is effectively prevented from being discharged excessively.

Fourth Embodiment

Figure 10:
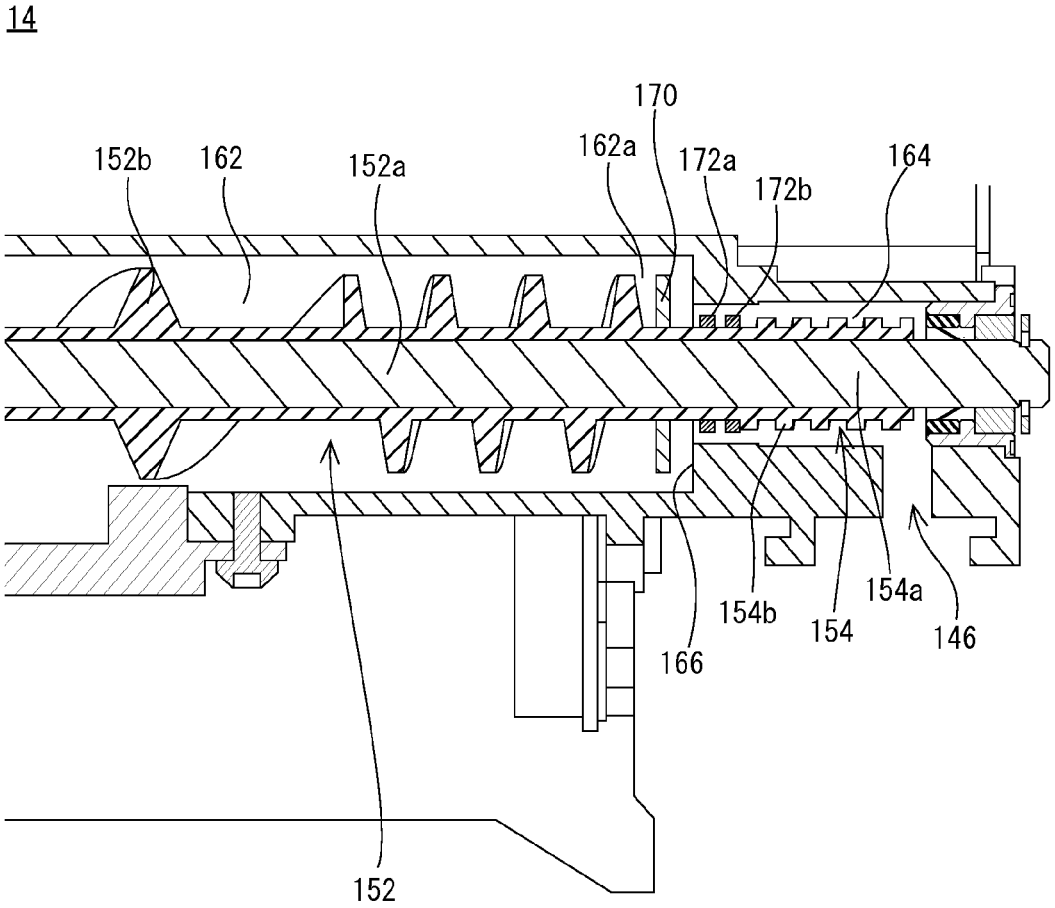
FIG. 10 is a schematic view enlarging a part of a sectional view of a developing apparatus of a fourth embodiment.

Subsequently, an image forming apparatus 10 that is the fourth embodiment according to the present invention will be described with reference to FIG. 10. Since the image forming apparatus 10 of the fourth embodiment is the same as the first embodiment except partly changing the structure of the developing apparatus 14, a duplicate description is omitted. FIG. 10 is a schematic view enlarging a part of a sectional view of the developing apparatus 14 of the fourth embodiment, corresponding to FIG. 7 in the first embodiment.

Briefly describing, in the fourth embodiment, two second annular plates 172*a* and 172*b* are provided side by side in an axial direction of the rotation axis of the third transporting member 154 with a predetermined interval in an end portion of the third transporting path 164 in the second transporting path 162 side. The interval of the two second annular plates 172*a* and 172*b* is made to be 1.0 mm, for example. The second annular plate 172*a* arranged in the second transporting path 162 side is located in a position slightly departed from the vertical surface 166 to a downstream side in the transporting direction of the developer by the third transporting member 154. The interval of the vertical surface 166 and the side surface of the second annular plate 172*a* in the first annular plate 170 side is made to be 1.0 mm, for example.

Such two annular plates 172*a* and 172*b* suppress that the developer flows into the third transporting path 164 from the second transporting path 162 more than required, and respectively function as a second regulation portion and a third regulation portion that the developer enters to the third transporting path 164 more than required due to the splash raising of the developer by the rotation of the second transporting member 152 (agitating vanes 152*a*), etc. and the internal pressure difference that occurs between the second transporting path 162 and the third transporting path 164 due to the rotation of the developing roller 156.

Furthermore, developer stagnation are formed respectively near the side surfaces of the second annular plates 172*a* and 172*b* on the bottom of the end portion of the third transporting path 164 in the second transporting path 162 side. Then, since these developer stagnation serve as barriers, respectively, it is suppressed that the developer flows into the third transporting path 164 from the second transporting path 162 more than required.

According to the fourth embodiment, the developer is, therefore, effectively prevented from being discharged excessively.

In addition, the vertical surface 166 and the side surface of the second annular plate 172*a* in the second transporting path side may be formed on the same plane. Furthermore, it is possible to arrange three or more second annular plates 172*a*, 172*b*, - - - side by side in an axial direction of the rotation axis of the third transporting member 154 with predetermined intervals.

Fifth Embodiment

Figure 11:
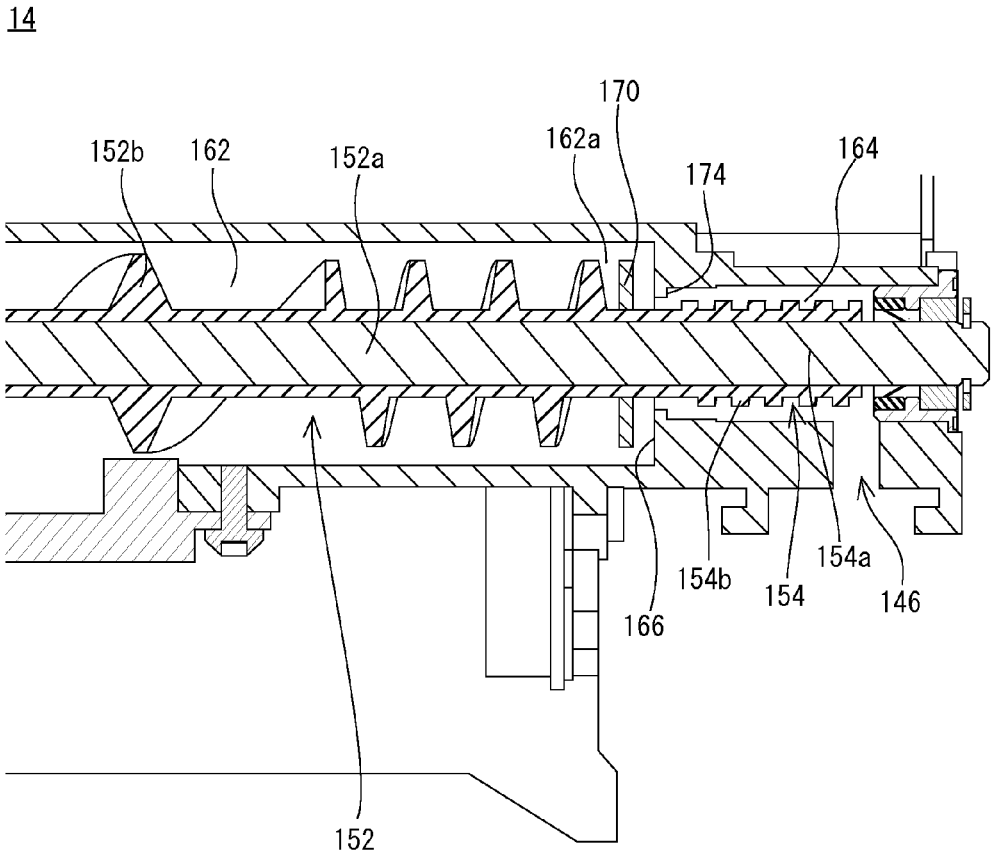
FIG. 11 is a schematic view enlarging a part of a sectional view of a developing apparatus of a fifth embodiment.

Subsequently, an image forming apparatus 10 that is the fifth embodiment according to the present invention will be described with reference to FIG. 11. Since the image forming apparatus 10 of the fifth embodiment is the same as the first embodiment except partly changing the structure of the developing apparatus 14, a duplicate description is omitted. FIG. 11 is a schematic view enlarging a part of a sectional view of the developing apparatus 14 of the fifth embodiment, corresponding to FIG. 7 in the first embodiment.

Briefly describing, in the fifth embodiment, there is provided with a third annular plate 174 that is projected from an inner circumference surface of the third transporting path 164 instead of providing the second annular plate 172 in an end portion of the third transporting path 164 in second transporting path 162 side. In this case, the third annular plate 174 suppresses that the developer flows into the third transporting path 164 from the second transporting path 162 more than required, and functions as a second regulation portion that the developer enters to the third transporting path 164 more than required due to the splash raising of the developer by the rotation of the second transporting member 152, etc. and the internal pressure difference that occurs between the second transporting path 162 and the third transporting path 164 due to the rotation of the developing roller 156.

In also the fifth embodiment, like the first embodiment, the developer is effectively prevented from being discharged excessively.

Sixth Embodiment

Figure 12:
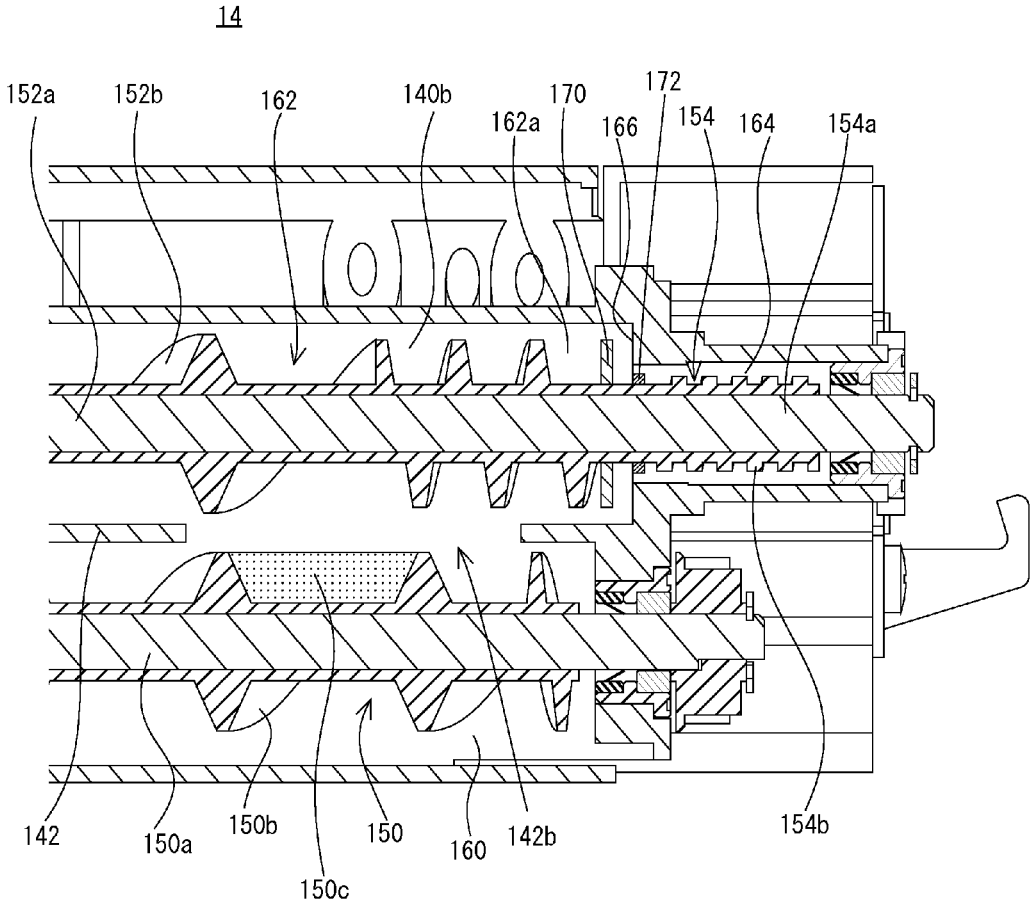
FIG. 12 is a schematic view enlarging a part of a sectional view of a developing apparatus of a sixth embodiment.

Subsequently, an image forming apparatus 10 that is the sixth embodiment according to the present invention will be described with reference to FIG. 12. Since the image forming apparatus 10 of the sixth embodiment is the same as the first embodiment except partly changing the structure of the developing apparatus 14, a duplicate description is omitted. FIG. 12 is a schematic view enlarging a part of a sectional view of the developing apparatus 14 of the fourth embodiment, corresponding to FIG. 6 in the first embodiment.

Briefly describing, in the sixth embodiment, an impetus of the developer transported in the first transporting path 160 is reduced in a downstream side of the transporting direction of the developer.

The developer transported in the first transporting path 160 is dammed up by the inner side wall of the developer vessel 140 in the downstream end portion in that transporting direction, whereby the impetus in the transporting direction can be reduced. However, the developer transported in the first transporting path 160 includes the developer that is transported to the second transporting path 162 via the slit 142*b* with the impetus not reduced. In such a case, since the impetus toward the downstream side of the transporting direction of the developer in the first transporting path 160 is not reduced, there is an occasion that the developer jumps over the stepwise difference with the impetus not reduced and thus overflows to the third transporting path 164. In this, the developer becomes to be discharged excessively. In order to avoid such inconvenience, in the sixth embodiment, in the downstream side of the transporting direction of the developer in the first transporting path 160, the impetus of the developer transported in this transporting direction is reduced.

Specifically, in the downstream side of the transporting direction of the developer by the first transporting member 150, there is provided, in a screw groove in a position opposite (corresponding) to a position that the slit 142*b* is formed, with a plate (paddle) 150*c* that is extended radially from the center of the screw axis 150*a* in parallel with the screw axis 150*a*.

In addition, in order to show the paddle 150*c* intelligibly, spots are added in FIG. 12. By providing this paddle 150*c*, it is possible to stay the developer in an upstream side than the paddle 150*c* in the transporting direction of the developer in the first transporting path 160. That is, the impetus of the developer transported in the first transporting path 160 is reduced in the upstream side than the paddle 150*c*. Therefore, the developer transported in the first transporting path 160 is prevented from being transported to the second transporting path 162 through the slit 142*b* as it is without reducing the impetus toward the transporting direction.

According to the sixth embodiment, the developer is, therefore, effectively prevented from being discharged excessively.

In addition, in the sixth embodiment, although a single paddle 150*c* is provided in the screw groove, not need to be limited to this. For example, two or more paddles 150*c* may be provided in a screw groove(s) while deviated from each other in a circumferential direction.

Furthermore, although the paddle 150*c* is formed in the sixth embodiment in order to reduce the impetus of the developer transported in the first transporting path 160 in the downstream side of this transporting direction of the developer, it is possible to adopt appropriate method as a method of reducing the impetus of the developer in the downstream side of the transporting direction of the developer in the first transporting path 160.

Although not shown, a part of the agitating vanes 150*b* of the first transporting member 150 may lack in a position corresponding to a position that the slit 142*b* is formed, for example. Furthermore, the number of turns of the agitating vanes 150*b* that is reversed in the downstream side of the transporting direction of the developer in the first transporting path 160 may be increased, for example. Furthermore, a width of the slit 142*b* may be narrowed, for example.

In addition, although each change of structure shown in the above-described second-sixth embodiments is described individually, it is possible to form a new device by combining technical features described in the respective embodiments or modified examples.

Although the present invention has been mentioned and illustrated in detail, it is clearly understood that the same is by way of illustration and example only and is not to be taken by way of limitation, the spirit and scope of the present invention being limited only by the terms of the appended claims.

What is claimed is:

1. A transporting apparatus, comprising:

a first transporting path that is provided in a developer vessel;

a first transporting member that is provided in the first transporting path to transport a developer while churning;

a second transporting path that is provided in the developer vessel in parallel with the first transporting path to be communicated with the first transporting path via communicating paths that are formed in both end portions in a longitudinal direction of a boundary wall between the first transporting path and the second transporting path;

a second transporting member that is provided in the second transporting path to transport a developer while churning in a reverse direction to the first transporting member and supply the developer to a developer bearing member;

a third transporting path that has a developer discharge port, and is connected, in the developer vessel, to the second transporting path in an upstream side of a transporting direction of the developer by the second transporting member;

a third transporting member that is provided in the third transporting path to transport a developer that overflows to the third transporting path from the second transporting path to the developer discharge port;

an annular plate-like first regulation portion that is arranged in an end portion of the second transporting path in a third transporting path side to be projected from an outer peripheral surface of an axis of the second transporting member and extended in a circumferential direction; and an annular plate-like second regulation portion that is arranged opposite to the first regulation portion with a predetermined interval in an end portion of the third transporting path in a second transporting path side, wherein the second regulation portion is provided on an inner circumferential surface of the third transporting path.

2. The transporting apparatus according to claim 1, wherein the second regulation portion is provided on an outer peripheral surface of an axis of the third transporting member.

3. The transporting apparatus according to claim 1, wherein the third transporting path is formed coaxially with the second transporting path, and an inner diameter thereof is smaller than an inner diameter of the second transporting path.

4. The transporting apparatus according to claim 1, wherein the second transporting path has an expanded portion that is formed to be projected to a third transporting path side in comparison to the communicating path that is arranged in a third transporting path side.

5. The transporting apparatus according to claim 1, further comprising an annular plate-like third regulation portion that is arranged in an end portion of the third transporting path in a second transporting path side to be opposed to the second regulation portion with a predetermined interval.

6. A developing apparatus comprising the transporting apparatus according to claim 1 and the developer bearing member.

7. An image forming apparatus comprising the developing apparatus according to claim 6.

* * * * *